US010955137B2

(12) United States Patent
Kim et al.

(10) Patent No.: US 10,955,137 B2
(45) Date of Patent: Mar. 23, 2021

(54) COMBUSTION DEVICE CAPABLE OF MEASURING GAS USE AMOUNT, AND METHOD FOR MEASURING GAS USE AMOUNT

(71) Applicant: KYUNGDONG NAVIEN CO., LTD., Pyeongtaek-si (KR)

(72) Inventors: Si Hwan Kim, Seoul (KR); Yong Min Song, Seoul (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 270 days.

(21) Appl. No.: 16/068,187

(22) PCT Filed: Dec. 9, 2016

(86) PCT No.: PCT/KR2016/014443
§ 371 (c)(1),
(2) Date: Jul. 5, 2018

(87) PCT Pub. No.: WO2017/119621
PCT Pub. Date: Jul. 13, 2017

(65) Prior Publication Data

US 2019/0024890 A1 Jan. 24, 2019

(30) Foreign Application Priority Data

Jan. 6, 2016 (KR) ..... 10-2016-0001524

(51) Int. Cl.
*F23N 1/04* (2006.01)
*F23N 3/02* (2006.01)
(Continued)

(52) U.S. Cl.
CPC ..... *F23N 1/047* (2013.01); *F23N 1/04* (2013.01); *F23N 3/02* (2013.01); *F23N 3/047* (2013.01);
(Continued)

(58) Field of Classification Search
CPC ... F23N 1/02; F23N 1/04; F23N 3/065; F23N 2233/08; F23N 2225/20; F23N 1/002; F24H 9/20
See application file for complete search history.

(56) References Cited

U.S. PATENT DOCUMENTS 10,520,186 B2 * 12/2019 Langius ..... F23N 1/025
2004/0214118 A1 10/2004 Sullivan
(Continued)

FOREIGN PATENT DOCUMENTS

CN 2811851 Y 8/2006
JP S63318417 A 12/1988
(Continued)

OTHER PUBLICATIONS

JP 2013076479 A by Miura Kogyo of Japan, Apr. 2013, Boiler, all pages, English machine translation. (Year: 2013).*
(Continued)

*Primary Examiner* — David J Laux
*Assistant Examiner* — Nikhil P Mashruwala
(74) *Attorney, Agent, or Firm* — STIP Law Group, LLC

(57) ABSTRACT

The objective of the present invention is to provide a combustion device capable of informing an amount of used gas, in which an air of gas temperature is reflected, to a user and a method of measuring the amount of used gas. To this end, the combustion device includes: a burner configured to burn gas; a blower configured to supply air for combustion to the burner; gas valves configured to supply gas for combustion to the burner; a gas temperature sensor configured to measure a temperature of gas supplied to the burner or the blower; and a control unit configured to control the number of revolutions of the blower, calculate a first amount of used gas for a present operating heat quantity burned according to a signal input by a user, and compensate the
(Continued)

calculated first amount of used gas with a measured gas temperature measured by the gas temperature sensor to calculate a second amount of used gas.

16 Claims, 5 Drawing Sheets

(51) Int. Cl.
*F24H 9/20* (2006.01)
*F23N 3/04* (2006.01)
*F23N 3/06* (2006.01)
*F23N 1/00* (2006.01)

(52) U.S. Cl.
CPC ..... *F23N 3/065* (2013.01); *F24H 9/20* (2013.01); *F24H 9/2064* (2013.01); *F23N 1/002* (2013.01); *F23N 2233/08* (2020.01)

(56) References Cited

U.S. PATENT DOCUMENTS

2005/0092317 A1* 5/2005 Hugghins ..... F23N 1/002 126/116 A
2008/0124668 A1* 5/2008 Schultz ..... F23N 1/027 431/89
2010/0316963 A1 12/2010 Kim
2011/0100349 A1* 5/2011 Hugghins ..... F23N 1/022 126/116 A
2013/0230812 A1* 9/2013 Schultz ..... F24H 3/065 431/12
2014/0061322 A1* 3/2014 Hrejsa ..... F24H 9/2085 236/11
2014/0080075 A1 3/2014 Young et al.
2019/0063742 A1* 2/2019 Kowald ..... F24H 9/1881

FOREIGN PATENT DOCUMENTS

JP H03175208 A 7/1991
JP 2013076479 A 4/2013
KR 2020000009881 A 6/2000
KR 100805630 B1 2/2008
KR 100960100 B1 5/2010
KR 101043894 B1 6/2011

OTHER PUBLICATIONS

International Search Report of PCT/KR2016/014443, dated Mar. 20, 2017, English Translation.

* cited by examiner

[FIG. 1]
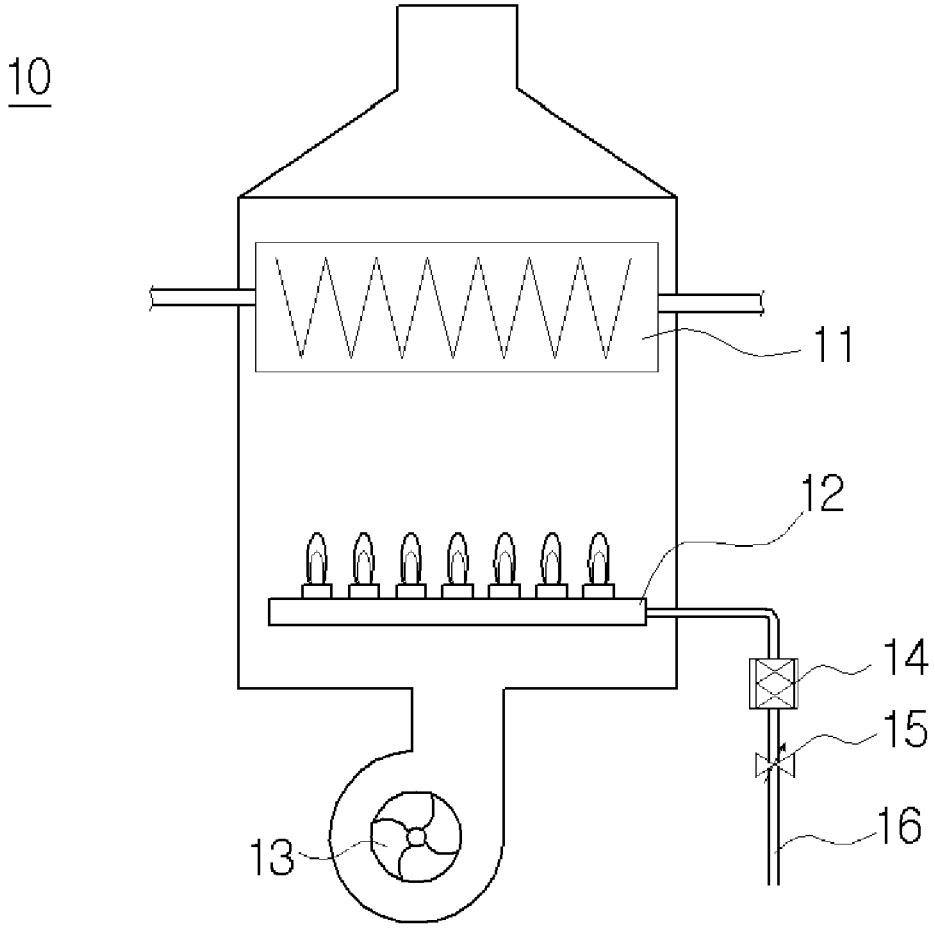
PRIOR ART

[FIG. 2]
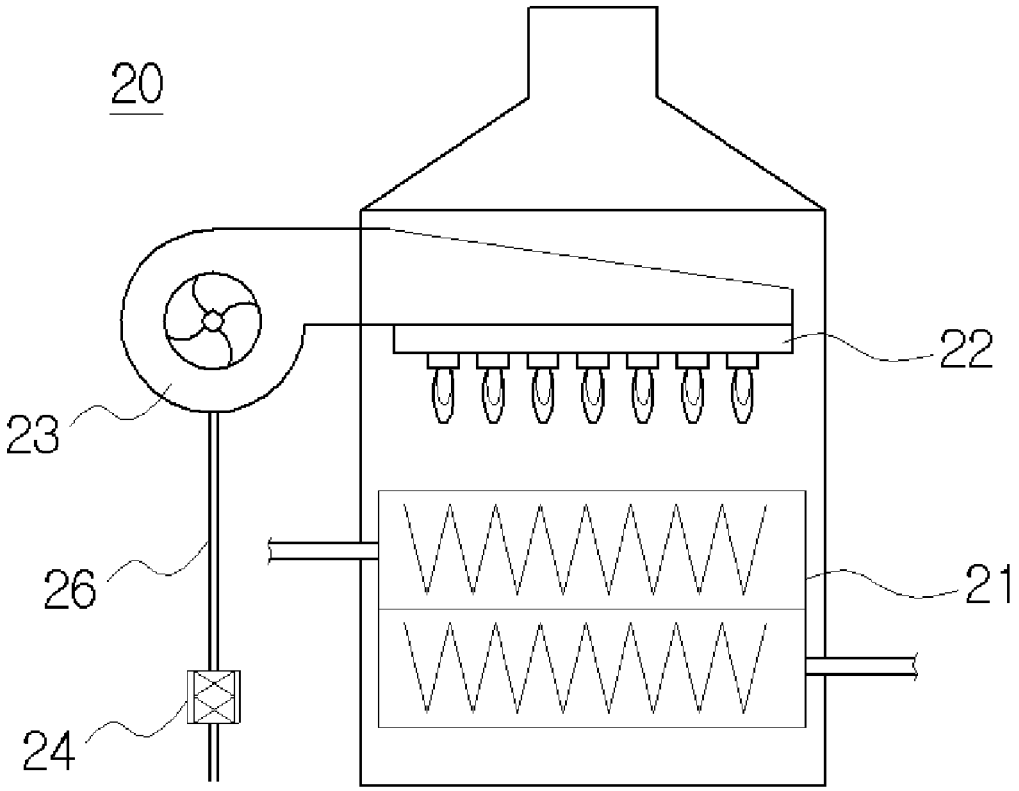
PRIOR ART

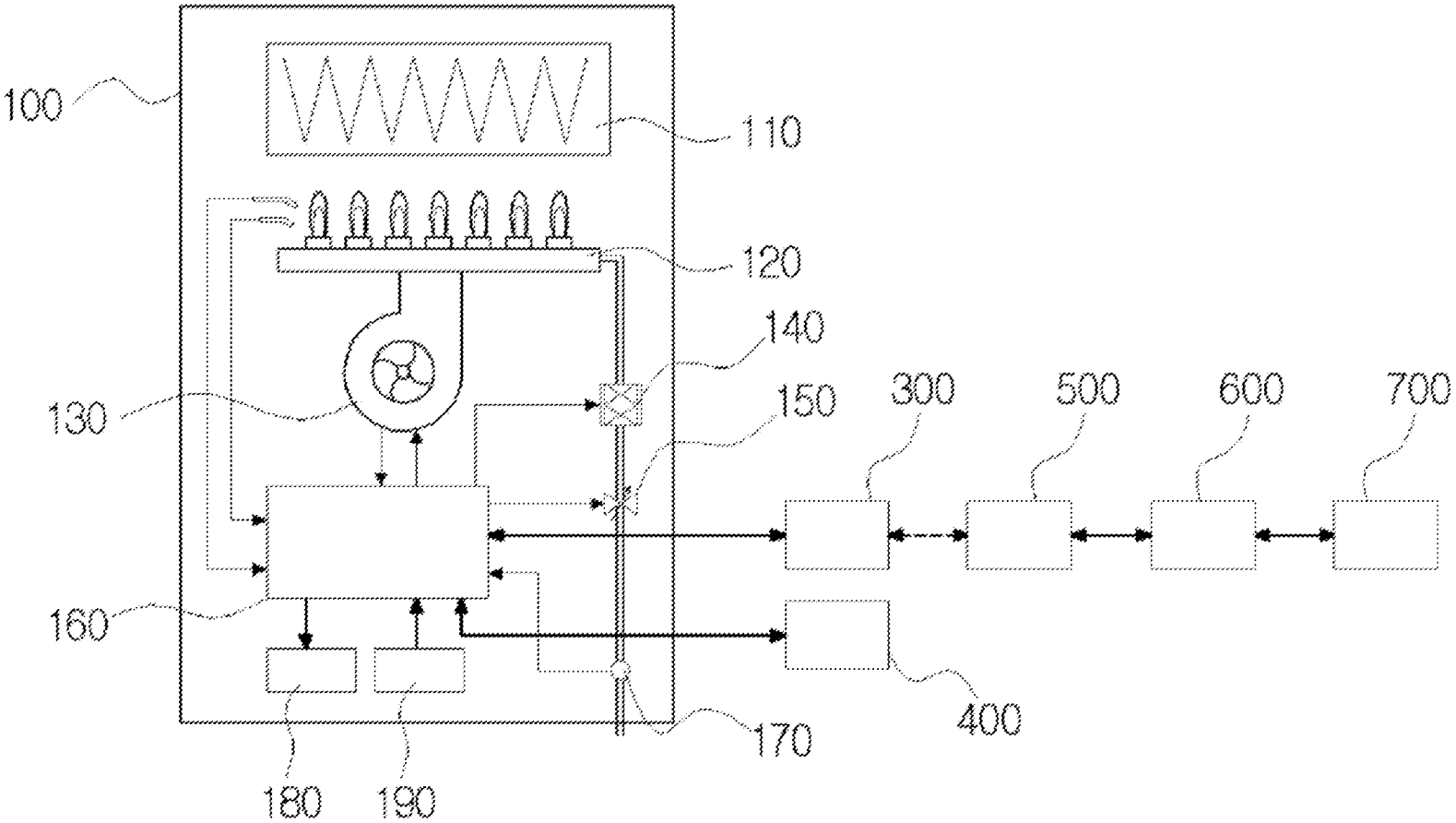
[FIG. 3]

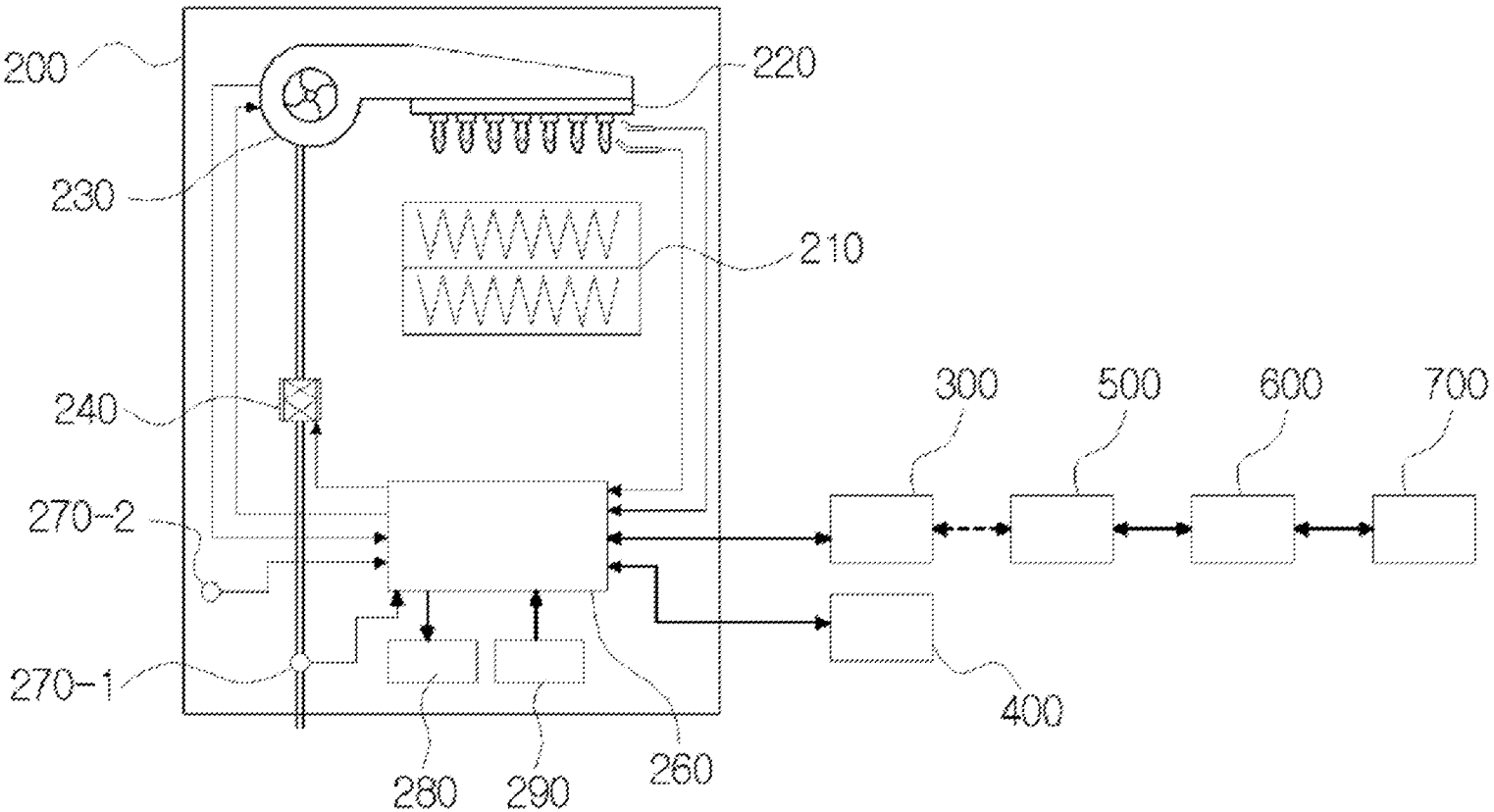
[FIG. 4]

[FIG. 5]
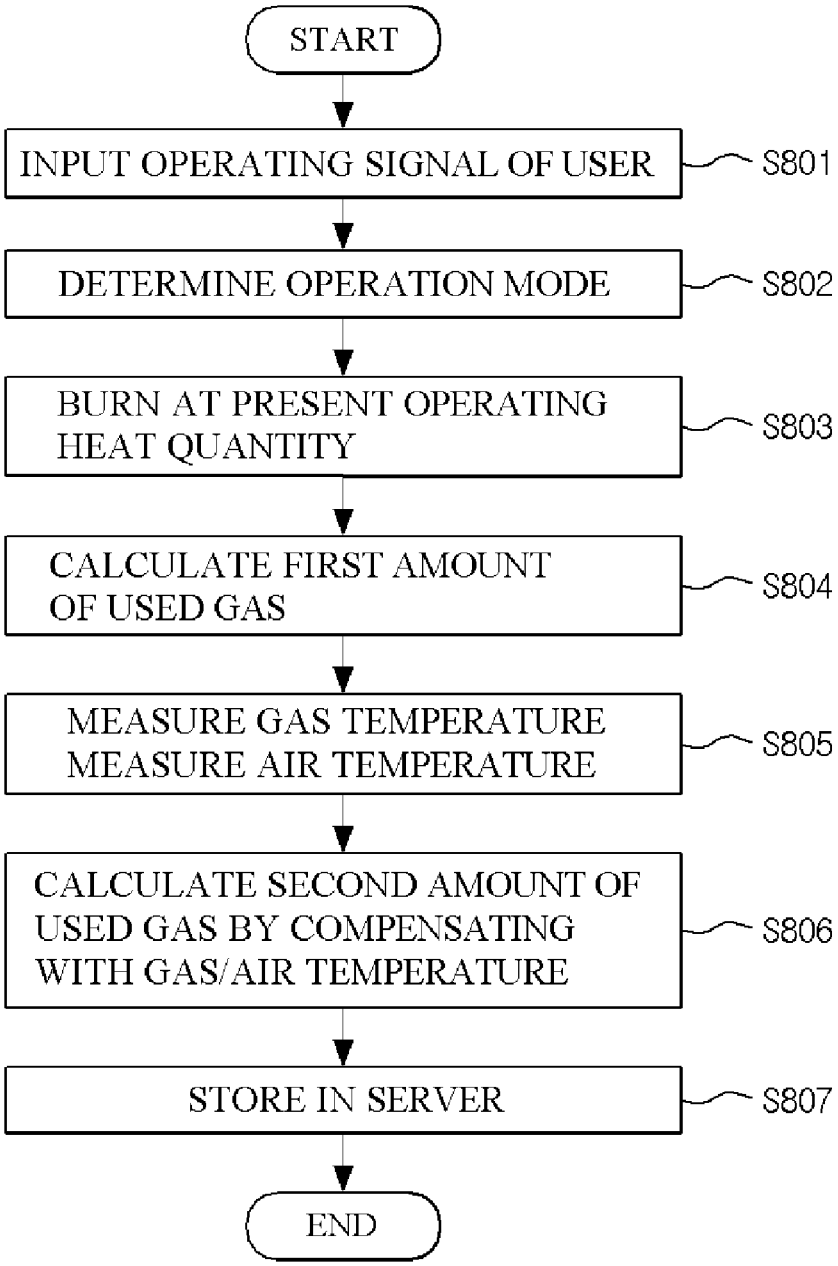

COMBUSTION DEVICE CAPABLE OF MEASURING GAS USE AMOUNT, AND METHOD FOR MEASURING GAS USE AMOUNT

CROSS-REFERENCE TO RELATED APPLICATIONS

This application is the U.S. National Phase under 35 U.S.C. § 371 of International Application No. PCT/KR2016/014443 filed on Dec. 9, 2016, which in turn claims the benefit of Korean Application No. 10-2016-0001524, filed on Jan. 6, 2016, the disclosures of which are incorporated by reference into the present application.

TECHNICAL FIELD

The present invention relates to a combustion device capable of measuring an amount of used gas and a method of measuring an amount of used gas, and more particularly, to a combustion device capable of measuring an amount of used gas, compensating the amount of used gas with an air or gas temperature, and informing the compensated amount to a user, and a method of measuring an amount of used gas.

BACKGROUND ART

Generally, a combustion device such as a gas boiler burns gas to generate heat to perform heating or supply hot water.

The combustion device may be divided into an electronic proportional control system and a pneumatic system according to a method of mixing air and gas.

Referring to FIG. 1, a combustion device 10 of an electronic proportional control system is a system in which air supplied by a blower 13 and gas supplied by an electronic proportional control valve 15 are individually supplied to a burner 12, and the air and the gas are mixed and burned in the burner 12. In such a system, a feed rate of gas is changed according to a current value of the electronic proportional control valve 15 configured to control a supply of gas. Accordingly, a quantity of heat and an amount of gas used in the system are determined by the electronic proportional control valve 15. Undefined numbers "11," "14," and "16" respectively denote a heat exchanger, a gas valve for controlling the supply of gas, and a gas supply pipe.

Referring to FIG. 2, a combustion device 20 of the pneumatic system is a system in which air supplied by a blower 23 and gas supplied by a pneumatic gas valve 24 are mixed in advance and supplied to the burner 22, and the air and the gas mixed in advance are burned in the burner 22. The pneumatic gas valve 24, which is provided on a gas supply pipe 26 through which gas is supplied, changes a feed rate of gas according to a pressure of the air supplied by the blower 23. Accordingly, a quantity of heat and an amount of gas used in such a system are determined by the number of revolutions of the blower. An undefined number "21" denotes a heat exchanger.

A related art configured to inform a user of an amount of used gas while a combustion device operates is disclosed in Korean Patent No. 10-1043894.

In the related art, the number of revolutions and a current value of a blower and a current value of a proportional valve are detected to calculate an amount of consumed gas.

Real amounts of used air and gas may be changed according to a temperature. That is, in the case in which a temperature is high, since volumes of air and gas increase, the numbers of particles of the air and the gas per unit volume decrease, and thus a real amount of used gas decreases. In addition, in the case in which a temperature is low, since volumes of air and gas decrease, the numbers of particles of the air and the gas per unit volume increase, and thus a real amount of used gas increases.

In the related art, since only the amount of used gas, in which temperatures of air and gas are not reflected, is calculated, there is a problem in that an accurate real amount of used gas may not be informed to a user. In addition, there is a problem in that information of various amounts of used gas according to operation modes may not be informed to a user.

DISCLOSURE

Technical Problem

The present invention is directed to providing a combustion device capable of informing an amount of used gas in which an air temperature or gas temperature is reflected and a method of measuring an amount of used gas.

The present invention is also directed to providing a combustion device capable of providing various pieces of information to a user by individually calculating amounts of used gas according to uses such as heating and hot water and a method of measuring an amount of used gas.

Technical Solution

One aspect of the present invention provides a combustion device an amount of used gas including: a burner (120, 220) configured to burn gas; a blower (130, 230) configured to supply air for combustion to the burner (120, 220); gas valves (140, 150, 240) configured to supply gas for combustion to the burner (120, 220); a gas temperature sensor (170, 270-1) configured to measure a temperature of gas supplied to the burner (120, 220) or the blower (130, 230); and a control unit (160, 260) configured to control the number of revolutions of the blower (130, 230), calculate a first amount of used gas for a present operating heat quantity burned according to a signal input by a user, and compensate the calculated first amount of used gas with a measured gas temperature measured by the gas temperature sensor (170, 270-1) to calculate a second amount of used gas.

Another aspect of the present invention provides a combustion device capable of measuring an amount of used gas including: a burner (220) configured to burn gas; a blower (230) configured to supply air for combustion to the burner (220); a gas valve (240) configured to supply gas for combustion to the burner (220); an air temperature sensor (270-2) configured to measure a temperature of air supplied by the blower (230); and a control unit (260) configured to control the number of revolutions of the blower (230), calculate a first amount of used gas for a present operating heat quantity burned according to a signal input by a user, and compensate the calculated first amount of used gas with a measured gas temperature measured by the gas temperature sensor (270-2) to calculate a second amount of used gas.

The gas valve (150) may include an electronic proportional control valve in which a feed rate of gas is determined according to a current value, and gas supplied through the electronic proportional control valve may be supplied to the burner (120) independently from air supplied by the blower (130).

The gas valve (240) may include a pneumatic gas valve in which a feed rate of gas is determined according to a difference in pressure generated in a flow path of air supplied by the blower (230).

The control unit (160, 260) may store the calculated second amount of used gas in a server (600) to display the calculated second amount of used gas on a portable terminal (700) of the user.

The control unit (160, 260) may store information of use for heating during a heating mode and information of use for hot water during a hot water mode in the server (600), the second amount of used gas may be calculated for each of the heating mode and the hot water mode, and the calculated second amount of used gas may be displayed on the portable terminal 700 according to selection of the user.

Still another aspect of the present invention provides a method of measuring an amount of used gas of a combustion device including a burner (120, 220) configured to burn gas, a blower (130, 230) configured to supply air for combustion to the burner (120, 220), gas valves (140, 150, 240) configured to supply gas for combustion to the burner (120, 220), and a control unit (160, 260) configured to control the burner (120, 220), the blower (130, 230), the gas valves (140, 150, 240), and the method includes: an operation of (a) supplying, by the gas valves (140, 150, 240) and the blower (130, 230), gas and air, and burning, by the burner (120, 220), the gas to supply a present operating heat quantity calculated based on a signal input by a user; an operation of (b) calculating, by the control unit (160, 260), a first amount of used gas for the present operating heat quantity; an operation of (c) measuring, by a gas temperature sensor (170, 270-1), a temperature of the gas, and transmitting the temperature to the control unit (160, 260); and an operation of (d) compensating, by the control unit (160, 260), the first amount of used gas with the measured gas temperature measured by the gas temperature sensor (170, 270-1) to calculate a second amount of used gas.

Yet another aspect of the present invention provides a method of measuring an amount of used gas of a combustion device including a burner (220) configured to burn gas, a blower (230) configured to supply air for combustion to the burner (220), a gas valve (240) configured to supply gas for combustion to the burner (220), and a control unit (260) configured to control the burner (220), the blower (230), and the gas valve (240), and the method includes: an operation of (a) supplying, by the gas valve (240) and the blower (230), gas and air, and burning, by the burner (220), the gas to supply a present operating heat quantity calculated based on a signal input by a user; an operation of (b) calculating, by the control unit (260), a first amount of used gas for the present operating heat quantity; an operation of (c) measuring, by an air temperature sensor (270-2), a temperature of the air, and transmitting the temperature to the control unit (260); and an operation of (d) compensating, by the control unit (260), the first amount of used gas with the measured air temperature measured by the air temperature sensor (270-2) to calculate a second amount of used gas.

The gas valve (150) may include an electronic proportional control valve in which a feed rate of gas is determined according to a current value; and the present operating heat quantity may be calculated from the current value of the electronic proportional control valve through an interpolation method.

A reference gas temperature of the gas may be set in the control unit (160, 260); and the second amount of used gas is calculated by a following equation:

second amount of used ∝first amount of used gas×reference gas temperature÷measured gas temperature.

The combustion device may further include a revolution detection sensor configured to measure the number of revolutions of the blower (230), and the present operating heat quantity may be calculated from the number of revolutions of the measured blower (230) measured by the revolution detection sensor through an interpolation method.

A reference air temperature of the air may be set in the control unit (260); and the second amount of used gas is calculated by a following equation:

second amount of used gas∝first amount of used gas×reference air temperature÷measured air temperature.

The control unit (160, 260) may measure and accumulate the second amount of used gas according to a set time interval, and transmit the accumulated amount of used gas to the server (600) in units of predetermined amounts of used gas, and the user may check the accumulated amount of used gas through a portable terminal (700) connected to the server (600).

The control unit (160, 260) may measure the first amount of used gas and the second amount of used gas for each of a plurality of modes and transmit the first and second amounts of used gas to the server (600), and the user may check the first and second amounts of used gas for each of the plurality of modes through the portable terminal (700) of the user.

Advantageous Effects

According to the present invention, since an amount of used gas, in which a temperature of air or gas is reflected, is calculated and provided to a user, further accurate information can be provided to the user.

Since amounts of used gas are calculated according to various operation modes and provided to the user, various pieces of information can be provided to the user.

Since the user can select and control gas use pattern on the basis of the various pieces of information, consumption of gas can be reduced and energy can be saved.

DESCRIPTION OF DRAWINGS

FIG. 1 is a view illustrating a conventional combustion device of an electronic proportional control system.

FIG. 2 is a view illustrating a conventional combustion device of a pneumatic system.

FIG. 3 is a view illustrating a combustion device according to a first embodiment of the present invention.

FIG. 4 is a view illustrating a combustion device according to a second embodiment of the present invention.

FIG. 5 is a flowchart of a method of measuring an amount of used gas according to the present invention.

REFERENCE NUMERALS

100, 200: COMBUSTION DEVICE
110, 210: HEAT EXCHANGER
120, 220: BURNER
130, 230: BLOWER
140, 240: GAS VALVE
150: ELECTRONIC PROPORTIONAL CONTROL VALVE
160, 260: CONTROL UNIT
170: GAS TEMPERATURE SENSOR
180, 280: DRIVING DEVICE
190, 290: SENSOR
270-2: AIR TEMPERATURE SENSOR

300: CONVERTER
400: ROOM CONTROLLER
500: GATEWAY
600: SERVER
700: PORTABLE TERMINAL

MODES OF THE INVENTION

Hereinafter, configurations and operations of exemplary embodiments of the present invention will be described in detail with reference to the accompanying drawings.

First Embodiment

A combustion device capable of measuring an amount of used gas according to a first embodiment will be described with reference to FIG. 3.

A combustion device 100 according to the first embodiment is an electronic proportional control system and includes a burner 120 configured to burn gas, a blower 130 for supplying air for burning to the burner 120, gas valves 140 and 150 for supplying gas for burning to the burner 120, a gas temperature sensor 170 for measuring a temperature of gas supplied to the burner 120, a control unit 160 configured to control the blower 130 and the gas valves 140 and 150 and calculate an amount of used gas by compensating with a measured gas temperature measured by the gas temperature sensor 170.

Combustion gas generated by combustion in the burner 120 exchanges heat with heating water in a heat exchanger 110 to heat the heating water. The heating water heated in the heat exchanger 110 is supplied to a heating target area (not shown) or a water supply heat exchanger (not shown) for supplying hot water.

Flames are generated in the burner 120 by an ignition device (not shown) which is ignited by a control signal of the control unit 160, and combustion is performed by the flames, and thus combustion gas is generated. Air and gas for combustion are individually supplied to the burner 120 by the blower 130 and gas valves 140 and 150, and the air and the gas are mixed and burned in the burner 120.

The number of revolutions of the blower 130 is determined by the control unit 160, and the blower 130 suctions external air and supplies the air to the burner 120.

The gas valves 140 and 150 include an opening and closing valve 140 configured to open or close according to a signal of the control unit 160 and an electronic proportional control valve 150 configured to control a feed rate of gas by adjusting an opening extent according to a current value based on a signal of the control unit 160.

The control unit 160 is connected to various driving devices 180 of the combustion device 100, and a sensor 190 for receiving information of a temperature, a flow rate, or the like.

In addition, an outer portion of the combustion device 100 is connected to a room controller 400, in which a user sets whether to operate the combustion device 100 and corresponding operating conditions, or execute a command, and a server 600 through a converter 300 and a gateway 500. An amount of used gas, a driving mode, and various pieces of information transmitted from the control unit 160 are stored in the server 600.

The user may receive the information stored in the server 600 through the portable terminal 700 to receive various pieces of information related to an operation of combustion device 100.

The gas temperature sensor 170 is provided on a pipe through which gas is supplied, measures a temperature of the supplied gas, and transmits the measured temperature to the control unit 160.

The control unit 160 calculates a first amount of used gas for a present operating heat quantity generated by combustion according to an input signal from the user, and a second amount of used gas by compensating the first amount of used gas with a measured gas temperature measured by the gas temperature sensor 170.

A volume of gas for combustion is changed according to a temperature. When a measured gas temperature is higher than a reference temperature of gas, a real amount of used gas decreases compared to when gas with a reference temperature is used. In addition, when a measured gas temperature is lower than the reference temperature, a real amount of used gas increases compared to when the gas with the reference temperature is used.

The first amount of used gas, which is an amount calculated using the present operating heat quantity, is a calculated value in which a gas temperature is not reflected, and the second amount of used gas is a real amount of used gas in which the gas temperature is reflected.

Second Embodiment

A combustion device capable of measuring an amount of used gas according to a second embodiment of the present invention will be described with reference to FIG. 4.

A combustion device 200 according to the second embodiment is a pneumatic system, and includes a burner 220 configured to burn gas, a blower 230 for supplying air for combustion to the burner 220, a gas valve 240 for supplying gas for combustion to the burner 220, a gas temperature sensor 270-1 for measuring a temperature of gas supplied to the blower 230, an air temperature sensor 270-2 for measuring a temperature of air supplied by the blower 230, and a control unit 260 configured to control the number of revolutions of the blower 230 and calculate a real amount of used gas by compensating with a measured air temperature and a measured gas temperature respectively measured by the air temperature sensor 270-2 and the gas temperature sensor 270-1.

The gas valve 240 is formed as a pneumatic gas valve which determines a feed rate of gas using a pressure difference generated on a flow path of air supplied by the blower 230.

The pressure difference generated by the flow path of air is determined by the number of revolutions of the blower 230. Accordingly, when the number of revolutions of the blower 230 increases, an amount of gas mixed with air through the gas valve 240 increases, and when the number of revolutions of the blower 230 decreases, an amount of gas mixed with air through the gas valve 240 decreases.

A revolution detection sensor for measuring the number of revolutions of the blower 230 is provided.

The control unit 260 calculates a first amount of used gas for a present operating heat quantity generated by combustion according to an input signal from the user, calculates a second amount of used gas by compensating the first amount of used gas with a measured gas temperature measured by the first gas temperature sensor 270-1, or calculates a second amount of used gas by compensating the first amount of used gas with a measured gas temperature measured by the second gas temperature sensor 270-2.

A relation between a temperature of gas for combustion and a real amount of used gas is the same as the case of the first embodiment described above.

A volume of air for combustion is also changed according to a temperature. When a measured temperature of air is higher than a reference temperature, a real amount of used air decreases compared to when air with a reference temperature is used. In addition, when a measured temperature of air is lower than the reference temperature, a real amount of used air increases compared to when the air with the reference temperature is used. In the case of the pneumatic system, since an amount of gas supplied through the gas valve 240 is proportional to an amount of air, a decrease or increase in a real amount of used air means a decrease or increase in a real amount of used gas.

The first amount of used gas, which is calculated from the present operating heat quantity, is a calculated value in which an air temperature and a gas temperature are not reflected, and the second amount of used gas is a real amount of used gas in which the air temperature or the gas temperature is reflected.

In the above description, although the first amount of used gas is compensated with one selected from a measured gas temperature and a measured air temperature, the first amount of used gas may be compensated along with the measured gas temperature and the measured air temperature.

Connection of the control unit 260 to a driving device 180, a sensor 190, a room controller 400, a converter 300, a gateway 500, a server 600, and a portable terminal 700 is the same as that of the first embodiment.

<Method of Measuring an Amount of Used Gas>

A method of measuring an amount of used gas performed by the combustion device of the present invention will be described with reference to FIG. 5.

In an operation S801, when a user manipulates the room controller 400 for performing heating or using hot water, the control units 160 and 260 respectively receive operating signals of the combustion devices 100 and 200.

In an operation S802, the control units 160 and 260 determine whether an operation mode selected by the user is heating mode or hot water mode.

In an operation S803, the control units 160 and 260 rotate blowers 130 and 230 to operate the combustion devices 100 and 200 to generate a present operating heat quantity, which is input by the user, supply gas through the gas valves 140, 150, and 240, and ignite the burners 120 and 220.

In this case, the user may select a desired heating temperature or hot water temperature using the room controller 400, and the control units 160 and 260 determine a quantity of heat to be generated by burning gas in the burners 120 and 220 according to the input heating temperature or the input hot water temperature.

The present operating heat quantity means a present output of each of the combustion devices 100 and 200, and the present output has a value ranging from 0 to 100 and defined as a ratio of a present output and a maximum output.

In this case, since an amount of gas supplied through the electronic proportional control valve is determined when a present output is determined in the combustion device 100 of the electronic proportional control system, a present operating heat quantity may be calculated using a current value of the gas valve 150 through an interpolation method.

In addition, since an amount of gas supplied through the gas valve 240 is determined according to the number of revolutions of the blower 230 when a present output of the combustion device 200 of the pneumatic system is determined, the present operating heat quantity may be calculated using the number of revolutions of the blower 230 measured by the revolution detection sensor through the interpolation method.

In an operation S804, the control units 160 and 260 calculate a first amount of used gas which is an amount of used gas burned to generate the present operating heat quantity.

For example, when a maximum amount of used gas of each of the combustion devices 100 and 200 is 24,000 Kcal/h, and the present operating heat quantity is 50% of the maximum amount of used gas, the first amount of used gas is 12,000 Kcal/h.

In an operation S805, a gas temperature is measured by the gas temperature sensors 170 and 270-1, and in the case of the pneumatic system, an air temperature is measured by the air temperature sensor 270-2, and measured information is transmitted to the control units 160 and 260.

In an operation S806, the control units 160 and 260 compensate the first amount of used gas with the measured gas temperature to calculate the second amount of used gas using following Equation 1.

second amount of used gas=first amount of used gas×(273+reference gas temperature)÷(273+measured gas temperature) [Equation 1]

For example, a reference gas temperature is assumed to be 15° and a measured gas temperature is assumed to be 25°. Since the measured gas temperature is higher than the reference gas temperature, a real amount of used gas decreases when compared to a case in which a gas temperature is the reference gas temperature. Since the first amount of used gas calculated in the operation S804 is 12,000 Kcal/h, a second amount of used gas is 11,597 Kcal/h.

In addition, in a case in which the control units 160 and 260 compensate with an air temperature, the control units 160 and 260 compensate the first amount of used gas with the measured air temperature to calculate a second amount of used gas using following Equation 2.

second amount of used gas=first amount of used gas×(273+reference air temperature)÷(273+measured air temperature) [Equation 2]

For example, a reference air temperature is assumed to be 20° and a measured air temperature is assumed to be 25°. Since the measured air temperature is higher than the reference air temperature, a real amount of used air (amount of used gas) decreases when compared to a case in which an air temperature is the reference air temperature. Since the first amount of used gas calculated in the operation S804 is 12,000 Kcal/h, a second amount of used gas is 11,798 Kcal/h.

In an operation S807, the control units 160 and 260 measure and accumulate the second amount of used gas at every set time, and calculate the accumulated amount of used gas per set amount of used gas.

For example, since the second amount of used gas means that 11,798 Kcal is used in one hour, an amount of used gas needs to be measured at a time interval shorter than one hour. In addition, informing a user of the amount of used gas in units of liters increases information transmission efficiency related to the amount of used gas.

Accordingly, in the present invention, the second amount of used gas is calculated at every 0.1 second, and the calculated values are accumulated and informed to the user in units of liters.

In the above example, an amount of used gas per 0.1 sec for 11,798 Kcal/h will be as follows.

$$11{,}798 \div 60 \div 60 \div 10 = 0.3277 \text{ Kcal}$$

When a heating value of gas currently used is assumed to be 10,204 Kcal/$m^3$, a volume of the gas for 0.3277 Kcal which is the calculated amount of used gas per 0.1 sec will be calculated as follows.

$$0.3277 \text{ Kcal} \times 1000 \text{ l} \div 10{,}204 = 0.0321 \text{ l}$$

That is, since 0.0321 l of gas is used per 0.1 sec, the control units 160 and 260 calculate in a method in which an accumulated amount of used gas is 1 l, 2 l, 3 l, or the like whenever an amount of used gas accumulated at every 0.1 sec is 1 l.

In the case of the pneumatic system, the second amount of used gas may be compensated along with a gas temperature and an air temperature. That is, the control unit 260 compensates the first amount of used gas with the measured gas temperature to calculate the second amount of used gas using Equation 1. Then, the control unit 260 additionally compensates the first amount of used gas, which is the second amount of used gas calculated using Equation 1, with the measured air temperature to calculate the second amount of used gas using Equation 2. Through the above-described process, the second amount of used gas may be calculated by being compensated along with the air temperature and the gas temperature in the pneumatic system through the above described process.

In the above-described Equation 1 and Equation 2, the reference gas temperature, the measured gas temperature, the reference air temperature, and the measured air temperature are described in an absolute temperature scale, when the second amount of used gas is inversely proportional to the measured gas temperature and the measured air temperature, the reference gas temperature, the measured gas temperature, the reference air temperature, and the measured air temperature may be described in a Celsius temperature scale, or Equation 1 and Equation 2 may be substituted with other equations.

In an operation S808, in the case of the electronic proportional control system, the control unit 160 stores the calculated first amount of used gas and the calculated second amount of used gas in the server 600.

The server 600 may store the first amount of used gas and the second amount of used gas which are divided into a heating mode amount and a hot water mode amount, or a total amount of used gas may be stored therein.

The user may check the first amount of used gas and the second amount of used gas stored in the server 600 through an application installed in the portable terminal 700 at any time.

Meanwhile, in the case of the pneumatic system, the control unit 260 stores the second amount of used gas compensated with the air temperature and the second amount of used gas compensated with the gas temperature and/or the second amount of used gas compensated along with the air temperature and the temperature in the server 600. Even in this case, the second amounts of used gas may be divided into the heating mode amount and the hot water mode amount and stored in the server 600. The user may check the second amount of used gas stored in the server 600 through the application installed in the portable terminal 700 at any time.

In addition, the user may check the first amount of used gas and the second amount of used gas which are displayed by yearly, weekly, daily or mode on the portable terminal 700 of the user. In addition, the amount of used gas of a month of a present year and that of the same month of the last year may be compared and displayed, and a present amount of used gas in a month, and a predicted amount of used gas and a gas charge at an end of the month may also be displayed. In addition, an alarm function in which the amount of used gas at the end of the month is informed to the user may be installed in the application.

As described above, since various pieces of information related to the amount of used gas is provided to the user, the user may easily observe the amount, initiatively select and control a gas use pattern to reduce gas consumption, which thus saves energy.

The present invention is not limited to the embodiments and is clear to those skilled in the art that the present invention may be variously modified and changed without departing from the technical gist of the present invention.

The invention claimed is:

1. A combustion device capable of measuring an amount of used gas comprising:

a burner (120, 220) configured to burn gas;

a blower (130, 230) configured to supply air for combustion to the burner (120, 220);

gas valves (140, 150, 240) configured to supply gas for combustion to the burner (120, 220);

a gas temperature sensor (170, 270-1) configured to measure a temperature of gas supplied to the burner (120, 220); and a control unit (160, 260) configured to control a number of revolutions of the blower (130, 230), calculate a first amount of used gas which is amount of used gas when burning with a present operating heat quantity according to a signal input by a user, and compensate the calculated first amount of used gas inversely proportional with a measured gas temperature measured by the gas temperature sensor (170, 270-1) to calculate a second amount of used gas which is a real amount of used gas.

2. The combustion device of claim 1, wherein:

the gas valve (150) includes an electronic proportional control valve in which a feed rate of gas is determined according to a current value; and gas supplied through the electronic proportional control valve is supplied to the burner (120) independently from air supplied by the blower (130).

3. The combustion device of claim 1, wherein the control unit (160, 260) stores the calculated second amount of used gas in a server (600) to display the calculated second amount of used gas on a portable terminal (700) of the user.

4. The combustion device of claim 3, wherein:

the control unit (160, 260) stores information of use for heating during a heating mode and information of use for hot water during a hot water mode in the server (600);

the second amount of used gas is calculated for each of the heating mode and the hot water mode; and the calculated second amount of used gas is displayed on the portable terminal 700 according to selection of the user.

5. The combustion device of claim 1, wherein:

a reference gas temperature of the gas is set in the control unit (160, 260); and the second amount of used gas is calculated by a following equation:

$$\text{second amount of used gas} \propto \text{first amount of used gas} \times \text{reference gas temperature} \div \text{measured gas temperature.}$$

6. A combustion device capable of measuring an amount of used gas comprising:

a burner (220) configured to burn gas;

a blower (230) configured to supply air for combustion to the burner (220);

a gas valve (240) configured to supply gas for combustion to the burner (220);

an air temperature sensor (270-2) configured to measure a temperature of air supplied by the blower (230); and a control unit (260) configured to control a number of revolutions of the blower (230), calculate a first amount of used gas which is amount of used gas when burning with a present operating heat quantity according to a signal input by a user, and compensate the calculated first amount of used gas inversely proportional with a measured gas temperature measured by the gas temperature sensor (270-2) to calculate a second amount of used gas which is a real amount of used gas.

7. The combustion device of claim 6, wherein the gas valve (240) includes a pneumatic gas valve in which a feed rate of gas is determined according to a difference in pressure generated in a flow path of air supplied by the blower (230).

8. The combustion device of claim 6, wherein:

a reference air temperature of the air is set in the control unit (260); and the second amount of used gas is calculated by a following equation:

second amount of used gas∝first amount of used gas×reference air temperature÷measured air temperature.

9. A method of measuring an amount of used gas of a combustion device including a burner (120, 220) configured to burn gas, a blower (130, 230) configured to supply air for combustion to the burner (120, 220), gas valves (140, 150, 240) configured to supply gas for combustion to the burner (120, 220), and a control unit (160, 260) configured to control the burner (120, 220), the blower (130, 230), the gas valves (140, 150, 240), the method comprising:

an operation of (a) supplying, by the gas valves (140, 150, 240) and the blower (130, 230), gas and air, and burning, by the burner (120, 220), the gas to supply a present operating heat quantity calculated based on a signal input by a user;

an operation of (b) calculating, by the control unit (160, 260), a first amount of used gas which is amount of used gas when burning with a present operating heat quantity;

an operation of (c) measuring, by a gas temperature sensor (170, 270-1), a temperature of the gas, and transmitting the temperature to the control unit (160, 260); and an operation of (d) compensating, by the control unit (160, 260), the first amount of used gas inversely proportional with a measured gas temperature measured by the gas temperature sensor (170, 270-1) to calculate a second amount of used gas which is a real amount of used gas.

10. The method of claim 9, wherein:

the gas valve (150) includes an electronic proportional control valve in which a feed rate of gas is determined according to a current value; and the present operating heat quantity is calculated from the current value of the electronic proportional control valve through an interpolation method.

11. The method of claim 9, wherein:

a reference gas temperature of the gas is set in the control unit (160, 260); and the second amount of used gas is calculated by a following equation:

second amount of used gas∝first amount of used gas×reference gas temperature÷measured gas temperature.

12. The method of claim 9, wherein:

the control unit (160, 260) measures and accumulates the second amount of used gas according to a set time interval, and transmits the accumulated amount of used gas to the server (600) in units of predetermined amounts of used gas; and the user checks the accumulated amount of used gas through a portable terminal (700) connected to the server (600).

13. The method of claim 9, wherein:

the control unit (160, 260) measures the first amount of used gas and the second amount of used gas for each of a plurality of modes and transmits the first and second amounts of used gas to the server (600); and the user checks the first and second amounts of used gas for each of the plurality of modes through the portable terminal (700) of the user.

14. A method of measuring an amount of used gas of a combustion device including a burner (220) configured to burn gas, a blower (230) configured to supply air for combustion to the burner (220), a gas valve (240) configured to supply gas for combustion to the burner (220), and a control unit (260) configured to control the burner (220), the blower (230), and the gas valve (240), the method comprising:

an operation of (a) supplying, by the gas valve (240) and the blower (230), gas and air, and burning, by the burner (220), the gas to supply a present operating heat quantity calculated based on a signal input by a user;

an operation of (b) calculating, by the control unit (260), a first amount of used gas which is amount of used gas when burning with a present operating heat quantity;

an operation of (c) measuring, by an air temperature sensor (270-2), a temperature of the air, and transmitting the temperature to the control unit (260); and an operation of (d) compensating, by the control unit (260), the first amount of used gas inversely proportional with a measured air temperature measured by the air temperature sensor (270-2) to calculate a second amount of used gas which is a real amount of used gas.

15. The method of claim 14, wherein:

the combustion device further includes a revolution detection sensor configured to measure a number of revolutions of the blower (230); and the present operating heat quantity is calculated from the the number of revolutions of the measured blower (230) measured by the revolution detection sensor through an interpolation method.

16. The method of claim 14, wherein:

a reference air temperature of the air is set in the control unit (260); and the second amount of used gas is calculated by a following equation:

second amount of used gas∝first amount of used gas×reference air temperature÷measured air temperature.

* * * * *